United States Patent [19]

Arai et al.

[11] Patent Number: 4,956,223

[45] Date of Patent: Sep. 11, 1990

[54] RECORDING MEDIUM AND RECORDING METHOD UTILIZING THE SAME

[75] Inventors: Ryuichi Arai, Sagamihara; Mamoru Sakaki, Atsugi; Shinya Matsui, Yokohama, all of Japan

[73] Assignee: Canon Kabushiki Kaisha, Tokyo, Japan

[21] Appl. No.: 17,035

[22] Filed: Feb. 18, 1987

Related U.S. Application Data

[63] Continuation of Ser. No. 789,463, Oct. 21, 1985, abandoned.

[30] Foreign Application Priority Data

Oct. 23, 1984 [JP] Japan ..... 59-223715

[51] Int. Cl.[5] ..... B41M 5/00

[52] U.S. Cl. ..... 428/212; 346/135.1; 428/195; 428/206; 428/207; 428/323; 428/324; 428/328; 428/329; 428/330; 428/331; 428/332; 428/334; 428/335; 428/336; 428/409; 428/913; 428/914

[58] Field of Search ..... 346/135.1; 428/195, 428/207, 211, 323, 324, 328, 913, 914, 206, 212, 329–332, 334–336, 409

[56] References Cited

U.S. PATENT DOCUMENTS

| | | | |
|---|---|---|---|
| 3,222,986 | 12/1965 | Altman | 350/105 |
| 3,388,027 | 6/1968 | Altman | 430/14 |
| 3,887,742 | 6/1975 | Reinnagel | 428/211 |
| 3,889,270 | 6/1975 | Hoffmann et al. | 346/135.1 |
| 4,025,673 | 5/1977 | Reinnagel | 428/207 |
| 4,269,891 | 5/1981 | Minagawa | 428/207 |
| 4,572,847 | 2/1986 | Haruta et al. | 428/409 |

FOREIGN PATENT DOCUMENTS

| | | | |
|---|---|---|---|
| 1349217 | 12/1963 | France | 428/207 |
| 1312115 | 4/1973 | United Kingdom | 428/211 |

*Primary Examiner*—Pamela R. Schwartz

*Attorney, Agent, or Firm*—Fitzpatrick, Cella, Harper & Scinto

[57] ABSTRACT

A recording medium is provided which comprises a recording surface causing a directional diffuse reflection. The recording medium has ink receptability, and its recording surface has a specific specular gloss and specific $Y_{10D65}$ value. A recording method which employs the recording medium is also provided.

7 Claims, 1 Drawing Sheet

RECORDING MEDIUM AND RECORDING METHOD UTILIZING THE SAME

This application is a continuation of application Ser. No. 789,463 filed Oct. 21, 1985, now abandoned.

BACKGROUND OF THE INVENTION

1. Field of the Invention

This invention relates to a recording medium suitable for use in recording methods using an ink, particularly a recording medium excellent in ink receptibility and distinctness of recorded image, as well as to a recording method utilizing said recording medium.

2. Description of the Prior Art

In ink jet recording, a recording liquid is discharged and converted to propelled droplets by various discharging methods such as (a) an electrostatic attraction method, (b) a method wherein a recording liquid receives mechanical vibration or displacement by a piezoelectric element and (c) a method wherein a recording liquid is heated to foam and the resulting pressure is utilized, whereby the part or whole of the propelled droplets are allowed to deposit onto a recording medium such as paper or the like. This ink jet recording is drawing public attention as a recording method which generates less noise and permits high speed and multicolor printing.

As the ink for ink jet recording, there are mainly used aqueous inks which meet the requirements for safety and recording characteristics, and these inks contain, in many cases, a polyhydric alcohol or the like for prevention of nozzle plugging and enhancement of discharging stability.

As the recording medium for ink jet recording, there have conventionally been used ordinary papers and so-called ink jet recording papers constituted of a substrate and a porous ink-receiving layer formed on the substrate. However, with the improvements of performance of ink jet recording equipment such as faster recording, multi-color recording and the like as well as with the spread of such equipment, superior and more flexible characteristics are being required for recording media. That is, a recording medium for ink jet recording capable of providing a recorded image of high resolution and high quality must satisfy basic requirements such as shown below.

(1) The reception of an ink by the recording medium is as quick as possible.

(2) When two ink dots overlap, the dot formed later does not penetrate into the dot formed previously.

(3) Ink dots spread on the recording medium within the range of the maximum acceptable diameter.

(4) The shape of ink dots formed on the recording medium is close to a true circle and the circumference of the circle is smooth.

(5) The ink dots formed on the recording medium have a high optical density and their circumferences are not blurred.

In order to obtain a recorded image quality comparable to that in color photography, by multi-color ink jet recording, the recording medium must further satisfy, such requirements as mentioned below in addition to the above basic requirements.

(6) The coloring components of ink can develop excellent colors on a recording medium.

(7) Since the ink droplets which number as many as the number of possible ink colors may possibly be deposited at the same spot, the recording medium is excellent particularly in ink fixing.

(8) The recording medium has a high degree of whiteness.

No recording medium is known yet which satisfies all the above requirements.

In many of conventional recording media for image formation consituted of a substrate and a porous ink-receiving layer formed on the substrate, a recording liquid is received by the pores of the ink-receiving layer and is fixed. Consequently, the recording liquid penetrates deep into the ink-receiving layer resulting in low distinction of recorded image.

Meanwhile, in conventional recording media constituted of a substrate and a non-porous ink-receiving layer formed on the substrate, a non-volatile component in ink such as a polyhydric alcohol remains on the recording media for a long time. (That is, the drying and fixing of ink takes long time.) This causes, when the recorded image is touched, staining of clothes or impairment of recorded image.

SUMMARY OF THE INVENTION

An object of the present invention is to provide (a) a recording medium for ink jet recording excellent particularly in ink receptibility and distinctness of a recorded image and (b) a recording method utilizing said recording medium.

Another object of the present invention is to provide (a) a recording medium for ink jet recording capable of producing an recorded image of sharp contrast, and giving perspective feeling and high quality sensation and (b) a recording method utilizing said recording medium.

The above objects can be achieved by the present invention.

According to one aspect of the present invention, there is provided a recording medium comprising a recording surface having a characteristic of directional diffuse reflection.

According to another aspect of the present invention, there is provided a recording medium comprising a substrate and an ink-receiving layer formed on the substrate, wherein a recording surface causes directional diffuse reflection.

According to further aspect of the present invention there is provided a recording method comprising forming droplets of a recording liquid and causing the droplets to deposit onto the surface of a recording medium, said recording medium comprising a recording surface which causes directional diffuse reflection.

DETAILED DESCRIPTION OF THE PREFERRED EMBODIMENT

Figure 1:
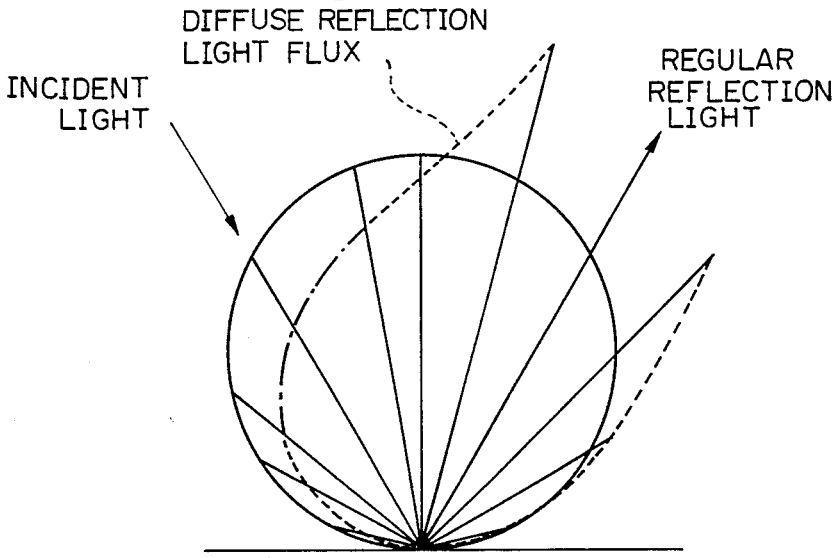
FIG. 1 shows the directional diffuse reflection of the recording medium of the present invention wherein a reflection light flux is distributed in an ellipsoidal form in the direction of specular reflection.

The recording medium of the present invention generally comprises a substrate and an ink-receiving layer formed on the substrate. Particularly preferred embodiments of the recording medium include the following.

(1) An embodiment wherein the substrate is opaque and causes diffuse reflection, the ink-receiving layer causes directional diffuse reflection, and the recording medium as a whole causes directional diffuse reflection.

(2) An embodiment wherein the substrate is transparent, the ink-receiving layer causes directional diffuse reflection and the recording medium as a whole causes directional diffuse reflection.

(3) An embodiment wherein the substrate causes directional diffuse reflection, the ink-receiving layer is transparent and the recording medium as a whole causes directional diffuse reflection.

In each of the above embodiments, the ink-receiving layer may also have a function as a supporting substrate.

As the substrate causing directional diffuse reflection used in the present invention, there are films causing multiple reflection, films containing a pigment causing directional diffuse reflection, and substrates obtained by dispersing in a resin a pigment causing directional diffuse reflection and coating the resulting resin on an ordinary substrate.

Specific examples of the films causing multiple reflection include Melinex (brand name), etc. Specific examples of pigments causing directional diffuse reflection include mica, pearl pigments, powders of metals such as aluminum, etc.

As the resin, there can be used any conventionally known resins. They include, for example, PVA, starch, acrylic resins and SBR latexes.

Besides, all the transparent or opaque substrates which have hitherto been known can be used in the present invention. Preferable as the transparent substrates are, for example, films or sheets of polyester resins, diacetate resins, triacetate resins, acrylic resins, polycarbonate resins, polyvinyl chloride resins, polyimide resins, Cellophane (brand name) and Celluloid (brand name), as well as glass plates. Preferable as the opaque substrates are, for example, ordinary papers, cloths, wood, metal plates, opaque films and synthetic papers, as well as substrates obtained by converting one of the above mentioned transparent substrates into an opaque substrate in accordance with a known method.

As the ink-receiving layer used in the present invention, there are mentioned materials having affinities with water and polyhydric alcohols used as liquid components of ink, such as, for example, natural resins (e.g. a polyvinyl alcohol, albumin, gelatin, casein, starch, cationic starch, gum arabic, sodium alginate) and synthetic resins e.g. a polyamide, a polyvinylpyrrolidone, a quaternized polyvinylpyrrolidone, a polyethyleneimine, a polyvinylpyridium halide, a melamine resin, a polyurethane, a carboxymethyl cellulose, a polyester, a SBR latex, an NBR latex, a polyvinyl formal, a polyvinyl methacrylate, a polyvinyl butyral, a polyacrylonitrile, a polyvinyl chloride, a polyvinyl acetate, a phenolic resin, and an alkyd resin. At least one of these materials is used so as to meet the application purpose. As understood by those of skill in the art, "materials having affinities with water and polyhydric alcohols" as recited hereinabove relates to those materials that are not hydrophobic or polyhydric alcoholphobic.

The ink-receiving layer can cause a directional diffuse reflection by dispersing in the layer, the above mentioned pigment showing a directional diffuse reflection.

In order for the ink-receiving layer to possess a controlled directionality in diffuse reflection and an enhanced ink receptibility, there can be dispersed in the ink-receiving layer fillers such as silica, clay, talc, diatomaceous earth, calcium carbonate, calcium sulfate, barium sulfate, aluminum silicate, synthetic zeolite, alumina, zinc oxide, lithopone and satin white.

The mixing ratio of filler to resin is preferably in the range of from 2:1 to 0:1. When this ratio is 0 (no filler is used), the recording medium corresponds to the embodiment (3) mentioned above. A ratio of 2 or more is not preferable because the recording medium becomes inferior in surface smoothness, resolution, gloss and contrast.

The ink-receiving layer can be formed according to the following methods. In a preferred method, the above mentioned resin and, as necessary, fillers are dissolved or dispersed in an appropriate solvent to prepare a coating fluid, and the coating fluid is coated on a light-transmissive substrate in accordance with a known method such as roll coating, rod bar coating, spray coating or air knife coating and then is dried rapidly. Besides, there can be used a method wherein the above mixture of resin and fillers is subjected to hot melt coating, or a method wherein a sheet for use as an ink-receiving layer is prepared from the above mentioned materials and the resulting sheet is laminated onto a substrate.

Cast coating may be employed in place of the above mentioned coating processes.

In the present invention, the thickness of the ink-receiving layer formed on a substrate is usually about 0.1 to 200 $\mu$m, preferably about 1 to 50 $\mu$m.

The present invention has been described above by explaining typical embodiments of the recording medium of the present invention. However, the recording medium of the present invention is not restricted to these embodiments. In any embodiment, the ink-receiving layer and/or the protective layer can contain various known additives such as a dispersing agent, a fluorescent dye, a pH-adjusting agent, an antifoaming agent, a lubricant, an antiseptic agent, a surfactant and the like.

Figure 2:
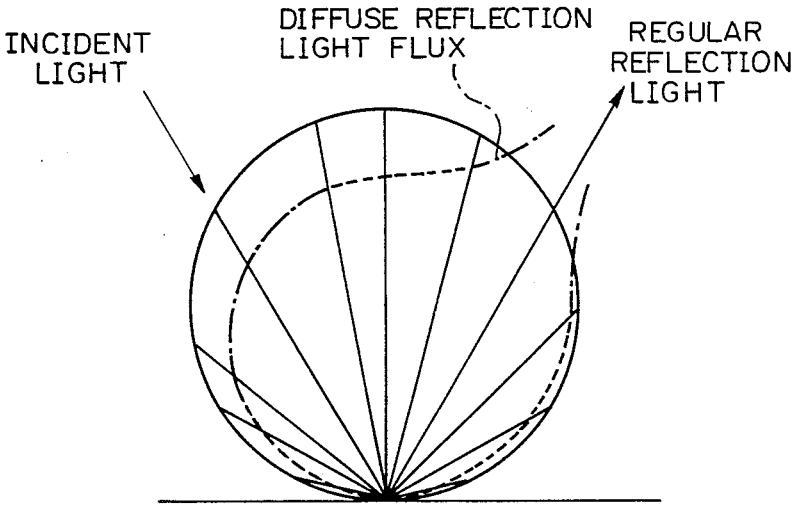
FIG. 2 shows an ordinary diffuse reflection wherein a reflection light flux is distributed in an almost spherical form.

In an ordinary diffuse reflection, as shown in FIG. 2, when an incident light flux reflects on the surface of an object, the distribution of the diffuse reflection light flux takes an almost spherical form except for the region of specular reflection. Accordingly, the amount of reflected light is largest in the direction normal to the object surface.

On the other hand, in the directional diffuse reflection referred to in the present invention, the distribution of the diffuse reflection light flux takes a form of an ellipsoid extending to the direction of specular reflection except for the region the of specular reflection. Accordingly, there are regions whose amounts of reflected light are larger than that in the direction normal to an object on which an incident light reflects Hence, in the directional diffuse reflection, larger amounts of reflected light than in an ordinary diffuse reflection are observed at certain angles, and at these angles the whiteness of the object is observed very high visually. Because of this reason, when ink jet recording is conducted, even if the directional diffuse reflection gives the same optical density as that of an ordinary diffuse reflection, the recorded image results in very sharp contrast, mellowness and perspective feeling which cannot be obtained in the ordinary diffuse reflection, within a certain range of solid angles of illumination and observation of the recorded image.

Further, in the recording medium of the present invention, when it has a 60° specular gloss of 30% or more as measured in accordance with JIS Z 8741, its surface is smooth and the recorded image has an improved resolution. This gloss in combination with high whiteness provides a distinct recorded image of high quality.

However, when the directionality of diffuse reflection light is extremely high, it occurs in some cases that the recorded image is observed dark at other visual angles. Hence, the recording medium of the present invention preferably has a $Y_{10D65}$ value of 60 or more as measured in accordance with JIS Z 8722 (D-0). The $Y_{10D65}$ value of 60 or more as measured under the condition of (D-0) means that 60% of the total amount of reflected light including specular reflection light is perceived visually and accordingly a certain amount of reflected light is secured at regions other than those of directional diffuse reflection so that the recorded image is not observed dark even when viewed from these regions.

The present invention will be explained in more detail below referring to Examples. In the following, parts refer to parts by weight.

EXAMPLE 1

As a substrate, there was used a white film causing a directional diffuse reflection [Melinex (brand name) #329 manufactured by ICI]. On this substrate was coated the following composition using the bar coater method so that the film thickness as dried became 3 μm. The coated substrate was dried for 10 min at 80° C. to obtain a recording medium a of the present invention.

| | |
|---|---|
| Hydroxyethyl cellulose (HEC AG-15 manufactured by Fuji Chemical Co.) | 5 parts |
| Barium sulfate | 0.5 parts |
| Water | 94 parts |

EXAMPLE 2

As a substrate, there was used a cast coated paper [Mirror Coat (brand name) manufactured by Kanzaki Paper Mfg. Co.]. This substrate was coated by the following composition using the bar coater method so that the film thickness as dried became 5 μm. The coated substrate was dried for 5 min at 100° C. to obtain a recording medium b of the present invention

| | |
|---|---|
| Pearl pigment [Iriodin (brand name) 100 Silver Pearl manufactured by Merck Co.] | 0.5 parts |
| Polyvinyl alcohol (PVA 420 manufactured by Kuraray Co.) | 5 parts |
| Water | 90 parts |

EXAMPLE 3

As a substrate, there was used an art paper [OK Art Post (brand name) manufactured by Oji Paper Mfg. Co.]. This substrate was coated by the following composition A using the bar coater method so that the film thickness as dried became 1 μm. The coated substrate was dried for 3 min at 100° C. Thereon was further coated the following composition B using the bar coater method so that the film thickness as dried became 3 μm. It was subjected to drying for 10 min at 80° C. to obtain a recording medium c of the present invention.

Composition A

| Composition A | |
|---|---|
| Polyvinyl alcohol (PVA-117 manufactured by Kuraray Co.) | 8 parts |
| Pearl pigment [Iriodin (brand name) 220 Blue Pearl manufactured by Merck] | 2 parts |
| Water | 90 parts |

Composition B

| Composition B | |
|---|---|
| Hydroxyethyl cellulose (HEC AH-15 manufactured by Fuji Chemical Co.) | 5 parts |
| Water | 95 parts |

COMPARATIVE EXAMPLE 1

The art paper used in Example 3 was used as a recording medium d.

COMPARATIVE EXAMPLE 2

A commercially available ink jet paper having no gloss [Ink Jet Mat Coat M (brand name) manufactured by Mitsubishi Paper Mills] was used as a recording medium e.

Ink jet recording was carried out with the recording media of the above Examples and Comparative Examples, using the following four kinds of inks and a recording equipment having an ink jet recording head of on-demand type wherein an ink is discharged using a piezoelectric vibrator (diameter of discharging orifice: 60 μm, voltage for driving a piezoelectric vibrator: 70V, frequency : 2 KHz).

| | |
|---|---|
| Yellow ink (composition) | |
| C.I. Direct Yellow 86 | 2 parts |
| Diethylene glycol | 20 parts |
| Polyethylene glycol #200 | 10 parts |
| Water | 70 parts |
| Red ink (composition) | |
| C.I. Acid Red 35 | 2 parts |
| Diethylene glycol | 20 parts |
| Polyethylene glycol #200 | 10 parts |
| Water | 70 parts |
| Blue ink (composition) | |
| C.I. Direct Blue 86 | 2 parts |
| Diethylene glycol | 20 parts |
| Polyethylene glycol #200 | 10 parts |
| Water | 70 parts |
| Black ink (composition) | |
| C.I. Food Black 2 | 2 parts |
| Diethylene glycol | 20 parts |
| Polyethylene glycol #200 | 10 parts |
| Water | 70 parts |

The evaluation results for the recording media of the above Examples and Comparative Examples are shown in Table 1. The evaluation items in Table 1 where measured in accordance with the following methods.

(1) Time of Ink Fixing

There was measured a time from recording to a moment at which no ink sticks to a finger when the finger touches a recorded image on a recording meidum.

(2) Dot Optical Density

The O.D. of black dot was measured by applying JIS K 7505 to printed microdots and using a Sakura Microdensitometer PDM-5 (manufactured by Konishiroku Photo Industry).

(3) Gloss

60° specular gloss was measured in accordance with JIS Z 8471 using a Digital Variable Angle Gloss Meter UGV-5D (manufactured by Suga Shikenki Co.).

(4) $Y_{10D65}$ Value

This value was obtained in accrdance with JIS Z 8722 from the spectral reflectance measured using a CA-35 Color Analyzer (manufactured by Murakami Color Research Laboratory).

(5) Gloss by Directional Diffuse Reflection (Reflectivity at 15° Direction)

This was obtained by applying a light onto a recording medium at an incident angle of −30° using Variable Angle Spectrophotometer of CA-35 Color Analyzer manufactured by Murakami Color Research Laboratory), measuring reflectivities at the directions of 0° and 15°, and calculating the reflectivity % at 15° direction as compared with the reflectivity at 0° direction being taken as 100%.

(6) Panel Test

This was conducted for overall evaluation of recorded image. An illustration of 15 cm×20 cm was printed on a recording medium; the resulting recording medium was shown to 20 panelists consisting of 12 males and 8 females; and there was counted the number of panelists who answer "yes" to the question whether they perceive especially high degree of whiteness and contrast, and high quality with distinctness and mellowness in the image-printed paper.

TABLE 1

| Evaluation item | Recording medium a | b | c | d | e |
|---|---|---|---|---|---|
| Time of ink fixing | Within 1 min. | Within 1 min. | Within 1 min. | 5 min. | Within 1 min. |
| Dot density | 1.3 | 1.2 | 1.3 | 0.5 | 0.7 |
| Gloss | 77% | 60% | 52% | 25% | 4% |
| $Y_{10D65}$ | 94 | 84 | 70 | 82 | 88 |
| Reflectivity at 15° direction | 128% | 105% | 160% | 87% | 88% |
| Panel test | 20 | 18 | 16 | 0 | 4 |

TABLE 1-continued

| Evaluation item | Recording medium a | b | c | d | e |
|---|---|---|---|---|---|
| | persons | persons | persons | person | persons |

Effect

As described above, when ink jet recording is conducted on a recording medium causing directional diffuse reflection, the resulting recorded image has a very high degree of whiteness at a certain visual angle. Hence, a recorded image of sharp contrast and distinction can be obtained.

Further, when the recording medium has a gloss, there can be obtained a recorded image excellent in resolution, gloss, perspective feeling due to pearl gloss and high quality feeling.

In the above, the recording medium of the present invention has been described in connection with ink jet recording. However, the recording medium is not restricted thereto and can of course be applied to other ink recordings such as, for example, heat-sensitive recording.

We claim:

1. A recording medium having a directional diffuse reflection property comprising a substrate and an ink-receiving layer formed on the substrate, said directional diffuse reflection property resulting from said substrate being a film which contains a pigment causing directional diffuse reflection said pigment being selected from the group consisting of mica, pearl pigment and metal powder; said ink-receiving layer containing a pigment and resin at a ratio in the range from 0:1 to 1:10.

2. A recording medium according to claim 1, wherein the recording surface has a 60° specular gloss of 30% or more as measured in accordance with JIS Z 8741.

3. A recording medium according to claim 1, wherein the recording surface has a $Y_{10D65}$ value of 60 or more as measured in accordance with JIS Z 8722(D-0).

4. A recording medium according to claim 1, wherein the recording surface has a 60° specular gloss of 30% or more as measured in accordance with JIS Z 8741 and a $Y_{10D65}$ value of 60 or more as measured in accordance with JIS Z 8722 (D-0).

5. A recording medium according to claim 1, wherein the ink-receiving layer comprises a resin having affinity with at least one of water and a polyhydric alcohol.

6. A recording medium according to claim 1, wherein the thickness of the ink receiving layer is in the range of from 0.1 to 200 μm.

7. A recording medium according to claim 1, wherein said pigment in the ink-receiving layer is selected from the group consisting of silica, clay, talc, diatomaceous earth, calcium sulfate, barium sulfate, aluminum oxide, lithopone and satin white.

* * * * *

UNITED STATES PATENT AND TRADEMARK OFFICE

CERTIFICATE OF CORRECTION

PATENT NO. : 4,956,223

DATED : September 11, 1990

INVENTOR(S) : Ryuichi Arai, et al.

It is certified that error appears in the above-identified patent and that said Letters Patent is hereby corrected as shown below:

COLUMN 2:

Line 8, "consituted" should read --constituted--.

COLUMN 4:

Line 51, "the of" should read --of the--.

Line 54, "reflects" should read --reflects.--.

COLUMN 5:

Line 32, delete "a" (second occurrence).

COLUMN 6:

Line 62, "where" should read --were--.

UNITED STATES PATENT AND TRADEMARK OFFICE

CERTIFICATE OF CORRECTION

PATENT NO. : 4,956,223

DATED : September 11, 1990

INVENTOR(S) : Ryuichi Arai, et al.

It is certified that error appears in the above-identified patent and that said Letters Patent is hereby corrected as shown below:

COLUMN 8:

Line 15, "tion" should read --tness--.

Line 32, "reflection said" should read --reflection, said--.

Signed and Sealed this

Second Day of June, 1992

*Attest:*

DOUGLAS B. COMER

*Attesting Officer*

*Acting Commissioner of Patents and Trademarks*